United States Patent [19]

Peck

[11] Patent Number: 4,644,929

[45] Date of Patent: Feb. 24, 1987

[54] LIMB STRUCTURE FOR ARCHERY BOWS

[75] Inventor: Paul L. Peck, Fond du Lac, Wis.

[73] Assignee: Archery Designs, Inc., North Fond du Lac, Wis.

[21] Appl. No.: 716,816

[22] Filed: Mar. 27, 1985

[51] Int. Cl.[4] ..... F41B 5/00

[52] U.S. Cl. ..... 124/24 R; 124/DIG. 1

[58] Field of Search ..... 124/23 R, 24 R, DIG. 1, 124/88; D22/5

[56] References Cited

U.S. PATENT DOCUMENTS

| | | | |
|---|---|---|---|
| 599,747 | 3/1898 | Stoddard | 124/24 R |
| 1,210,332 | 12/1916 | Kvistad | 124/24 R |
| 2,957,489 | 10/1960 | Wilkerson | 124/24 R |
| 3,757,762 | 9/1973 | Cousin | 124/24 R |
| 3,766,904 | 10/1973 | Izuta | 124/24 R |
| 4,060,066 | 11/1977 | Kudlacek | 124/DIG. 1 |
| 4,201,182 | 5/1980 | Butler | 124/24 R |
| 4,350,138 | 9/1982 | Caldwell | 124/24 R |

FOREIGN PATENT DOCUMENTS 3300278 7/1983 Fed. Rep. of Germany ..... D22/5

OTHER PUBLICATIONS

Bow and Arrow Magazine Advertisement, p. 14, Dec. 1985.

*Primary Examiner*—Leo P. Picard
*Assistant Examiner*—Benjamin Layno
*Attorney, Agent, or Firm*—Michael, Best & Friedrich

[57] ABSTRACT

The compound bow has a rigid riser with a flexible limb at each end. Each limb includes a pair of parallel limb elements of substantially uniform width and a pulley is mounted between the outer ends of each pair of limb elements. The inner ends of each pair of limb elements are connected to the riser by a bridge adjustable relative to the riser. The limbs are pivoted on the riser and a cable and bow string are connected between the outer ends and reeved over the pulleys. The space or angle between the inner limb ends and the bridge can be adjusted.

7 Claims, 6 Drawing Figures

LIMB STRUCTURE FOR ARCHERY BOWS

BACKGROUND OF THE INVENTION

As archery bows have been improved from the long bow to the recurve, to the compound and the improved compound bow, the load and shock applied to the limbs of the bow have increased dramatically. Limb breakage has increased significantly. U.S. Pat. No. 4,350,138 ascribes the breakage to transverse twisting of the limb and undertakes to solve the problem by axially splitting the limb. This simply applied half as much twist to half the limb and the breaking continued. The split limb construction results from providing a notch at the tip of the limb for the pulley in a compound bow. The provision of the notch, however, results in varying width asymmetrical limb elements and, in my opinion, this has caused twisting.

The split limb construction also develops another problem by way of inventory in manufacturing the bow or in replacement of limbs. Thus, the prior art required "right" and "left" side limb elements and both to be carried in inventory. Furthermore, when manufacturing the limb, the two halves of the split limb do not necessarily have the same flex characteristics and this can further compound the problem. Obviously, when replacing a single broken limb element the problem is even more severe.

SUMMARY OF THE INVENTION

This invention provides a longitudinally flexible limb element for an archery bow. The element has substantially uniform width from its inner end to its outer end and has means at its outer end for connection to a bow string. The inner end may be stiffened to absorb load concentrations. A pivot is provided between the ends of the element.

More specifically the invention provides an archery bow including a rigid section with an improved limb connected to the rigid section and a bow string connected to the limb to flex the limb as the bow string is drawn. The improved limb includes two parallel limb elements of substantially uniform width. The inner end of each of the limb elements is connected to the rigid section while the outer ends are connected to the bow string. Each element is pivoted between its ends to a pivot on the rigid section.

The limb elements are connected to the rigid section by a bridge straddling the inner ends of the limb elements. The bridge is adjustably connected to the rigid section with the inner limb ends between.

Another feature is the provision of an adjustable connection between the bridge and the inner end of each of said limb elements.

The invention provides a compound bow having a rigid riser having a flexible limb at each end, each limb including a pair of parallel limb elements of substantially uniform width. A pulley is mounted between the outer ends of each pair of limb elements and the inner ends of each pair of limb elements are connected to the riser. The limb elements are pivoted on the riser and a cable and bow string is connected between said outer ends and reeved over said pulleys.

DETAILED DESCRIPTION OF THE DRAWINGS

Figure 1:
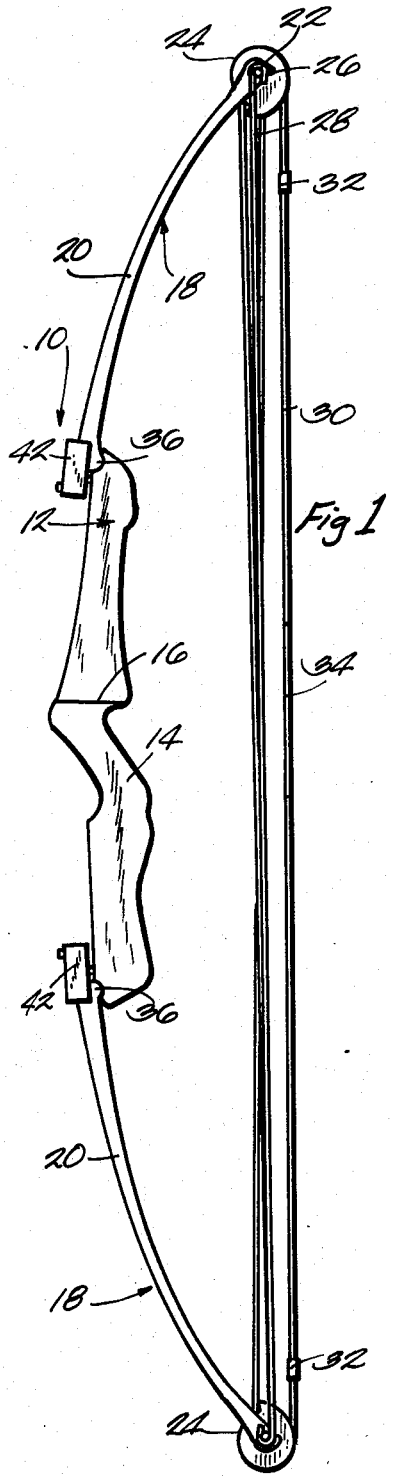
FIG. 1 is a side elevation of a compound bow of the cantilevered limb type.
Figure 2:
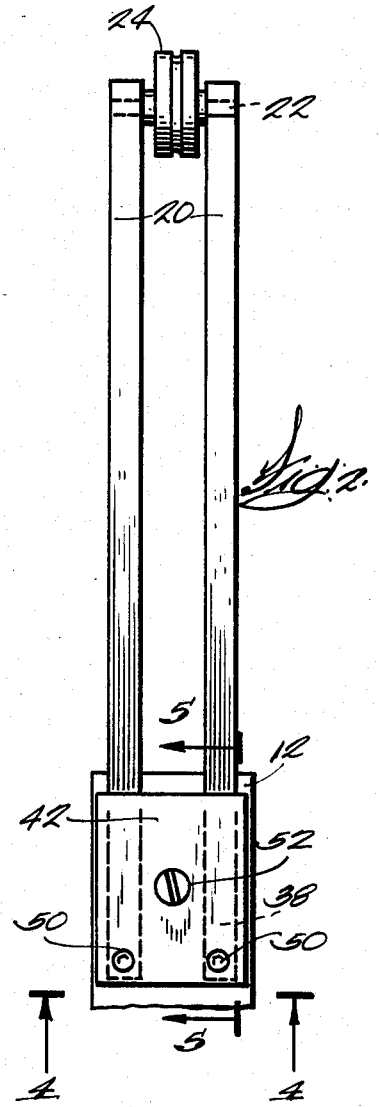
FIG. 2 is an enlarged, detailed view of a limb having two limb elements.
Figure 3:
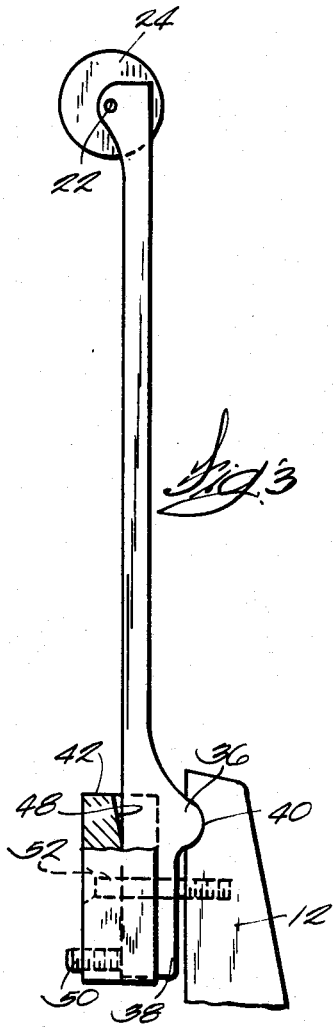
FIG. 3 is a side view of FIG. 2.
Figure 4:
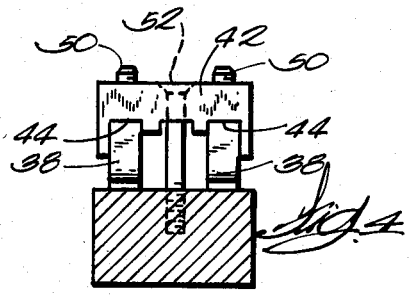
FIG. 4 is a view taken on line 4—4 in FIG. 2.

The compound bow 10 has the customary rigid riser section 12 which includes hand grip 14 and arrow rest 16. A limb 18 is mounted on each end of the riser 12. Each limb includes two spaced, parallel limb elements 20. The outer end of each limb element provided is enlarged to support axle 22 of pulley 24. The cable 28 is customarily anchored on the axle 22 as seen in FIG. 1 at 26. The cable is reeved over pulley 24 and is connected to bow string 30 by means of connectors 32. In use, the arrow is nocked in the area of the bow string 30 covered by the serving 34.

The inner end of each limb element 20 is connected to the riser. Each inner end includes a transverse semicylindrical pivot 36 which is the forward portion of a thick base 38 which adds strength to the inner end of each limb element. This is desireable with a cantilevered limb to avoid too much flexure at the inner end. The pivot 36 of each limb element is received in a corresponding groove 40 in the outer end of the riser 12. A bridge 42 is provided with two spaced-apart channels or saddles 44 on the side facing the riser. These saddles fit over the inner ends of each of the limb elements 20.

Figure 5:
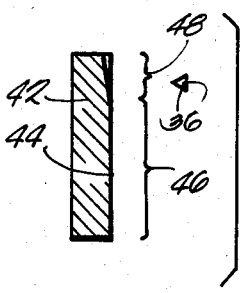
FIG. 5 is a longitudinal section taken as indicated by line 5—5 in FIG. 2.

As may be seen in FIG. 5, each saddle 44 is substantially flat over that portion of the saddle designated 46 in FIG. 5 lying between the effective center of the pivot and the inner end of the saddle. Forwardly of the forward edge of the flat 46, there is a chamfer 48 which permits rocking movement of the limb element relative to the bridge in response to an adjusting screw 50 being turned down to push the inner end of the limb element away from the flat saddle area 46. As this happens the entire limb pivots around the pivot connection to the riser and chamfer 48 allows the motion. This allows the position of the limb element to be adjusted relative to the bridge and relative to the adjacent limb element, thus permitting the flex characteristics of the tow limb elements to be more closely matched.

The principal connection of the limb elements to the riser 12 is via the screw 52 threaded into the tip of the riser 12 with the screw head engaging the outside of the bridge. Thus, this screw is adjusted to change the flex of both limbs simultaneously. It will be understood that this will adjust the draw weight (the force required to draw the bow string) of both limb elements simultaneously.

The thickness of the limb elements can be varied over the length of the limb element for various reasons related to strength, desired flex characteristics and the like. Such variation in thickness, i.e., the distance between the front and back sides of the limb element, falls within the scope of this invention. The important feature of this invention is the uniform width of the limb elements. With uniform width (uniform distance between the edges of the limb elements) flexure does not cause twisting. Therefore, there is simply longitudinal flexing of each element and the limb twist problems of the prior art are avoided. Thus, life expectancy of the limb elements is substantially increased.

Figure 6:
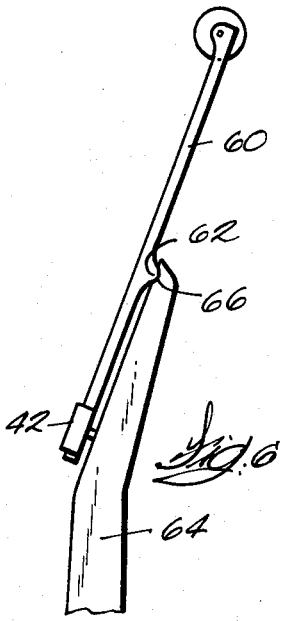
FIG. 6 is a view similar to FIG. 3, but shows the type of limb pivoted in the middle.

As described thus far, the bow is provided with a cantilevered limb arrangement. The same concept can be applied to limbs pivoted in the middle as shown in FIG. 6 where the limb element 60 has a central pivot 62. The inner end does not need to be provided with the thick base (38 in the cantilevered version). The bridge straddles the inner ends 42. The riser 64 has to be somewhat longer to provide the pivot 66 at its outer end (further from the hand grip). This arrangement differs from the cantilevered limb arrangement in the distance between the bridge and the pivot. With the cantilevered arrangement the pivot is close to the bridge while in the arrangement of FIG. 6 the pivot is about at the midpoint of the limb. The principle is the same and fine tuning of the individual limb elements can be provided in either arrangement. In both modifications the limb elements are parallel and spaced apart in side-by-side manner.

Since there is less mass in the limb elements and since there is virtually no twisting of the limb elements, more usable energy is delivered to the arrow. Therefore, the arrow is cast somewhat faster. Since there is less unusable energy to be dissipated at the end of the shot, there is less shock to the bow and the limbs.

I claim:

1. In an archery bow including a rigid section, a limb connected to said rigid section, and a bow string connected to said limb, said limb being flexed as said bow string is drawn, the improvement comprising a new limb structure including, two spaced parallel limb elements of substantially uniform width, each of said limb elements having an inner end and an outer end, means connecting the inner end of each of said limb elements to said rigid section so said limb elements project therefrom in side-by-side manner in generally the same plane, means between the outer ends of said limb elements for connection to said bow string, pivot means on each said limb element between said ends, pivot means on said rigid section cooperating with said pivot means on each limb element.

2. A bow according to claim 1 in which said connecting means includes a bridge straddling the inner ends of said limb elements, and adjustable means connecting said bridge to said rigid section with said limb elements between.

3. A bow according to claim 2 including an adjustable connection between said bridge and the inner end of each of said limb elements.

4. An archery bow according to claim 3 in which said rigid section comprises a riser provided with such a new limb structure at each end of said riser.

5. A compound bow having a rigid riser having a flexible limb at each end, each limb including a pair of parallel limb elements of substantially uniform width arranged in spaced side-by-side manner throughout their length, each of said limb elements having an inner end and an outer end, a pulley mounted between the outer ends of each pair of limb elements, means connecting the spaced inner ends of each pair of limb elements to said riser, pivot means between each pair of said limb elements and said riser, and a cable and bow string connected between said outer ends of said limbs and reeved over said pulleys.

6. A bow according to claim 5 in which said connecting means includes a bridge straddling the spaced inner ends of said limb elements, and including adjustable means connecting said bridge to said rigid section with said spaced limb elements between.

7. A bow according to claim 6 including an adjustable connection between said bridge and the inner end of each of said limb elements.

* * * * *